United States Patent [19]

Ohmori et al.

[11] Patent Number: 4,598,683

[45] Date of Patent: Jul. 8, 1986

[54] FUEL INJECTION PUMP OF THE DISTRIBUTION TYPE

[75] Inventors: Toshihiko Ohmori, Nagoya; Sinya Sumitani, Anjo; Takio Tani, Kariya; Masahiko Miyaki, Oobu; Akira Masuda, Aichi, all of Japan

[73] Assignee: Nippondenso Co., Ltd., Kariya, Japan

[21] Appl. No.: 711,060

[22] Filed: Mar. 12, 1985

[30] Foreign Application Priority Data

Mar. 15, 1984 [JP] Japan ..... 59-49663
Mar. 15, 1984 [JP] Japan ..... 59-49665

[51] Int. Cl.[4] ..... F02M 39/00

[52] U.S. Cl. ..... 123/450; 123/446; 123/447

[58] Field of Search ..... 123/450, 458, 447, 357–359, 123/446; 417/462, 463

[56] References Cited

U.S. PATENT DOCUMENTS

| | | | |
|---|---|---|---|
| 3,598,507 | 8/1971 | Voit | 123/450 |
| 4,428,346 | 1/1984 | Hoshi | 123/450 |
| 4,445,822 | 5/1984 | Hoshi | 123/450 |
| 4,450,813 | 5/1984 | Takano | 123/450 |
| 4,492,200 | 1/1985 | Takahashi | 123/450 |

*Primary Examiner*—Carl Stuart Miller
*Attorney, Agent, or Firm*—Cushman, Darby & Cushman

[57] ABSTRACT

A distribution type fuel injection pump includes a control cylindrical bore into which a control plunger is fitted. The control plunger partitions the control cylindrical bore into first and second chambers. The same pressure as that of fuel in the pumping chamber (which serves to feed fuel) is transmitted to the first chamber, while fuel is supplied to the second chamber through a control passage. An electromagnetic valve is arranged in the control passage and the amount of fuel with which the second chamber is filled is adjusted by controlling the electromagnetic valve.

16 Claims, 13 Drawing Figures

FUEL INJECTION PUMP OF THE DISTRIBUTION TYPE

BACKGROUND OF THE INVENTION

The present invention relates to a fuel injection pump of a distribution type for delivering fuel to the combustion chambers of an internal combustion engine and, more particularly, it relates to a distribution type fuel injection pump capable of electrically controlling the fuel injection timing and/or the injection ratio characteristics.

This distribution type fuel injection pump is disclosed by Japanese Patent Disclosure No. 148051/57. This well-known fuel injection pump is provided with an electromagnetic valve for controlling the amount of fuel injected, and is located in the suction passage through which fuel is supplied to the pump chamber so that it opens and closes the suction passage to control the amount of fuel sucked into the pump chamber, and therefore, the amount of fuel injected. More specifically, the electromagnetic valve is of the usually-closed type and the amount of fuel sucked into the pump chamber can be adjusted by controlling the time period during which the electromagnetic valve is opened. When the electromagnetic valve is employed, therefore, the amount of fuel injected can be controlled electrically.

In a case where the fuel injection timing and/or the injection ratio characteristic are to be electrically controlled, however, various matters still prevent an effective fuel injection pump from being provided. Accordingly, there has been demanded a distribution type fuel injection pump capable of effectively and electrically controlling the fuel injection timing and/or injection ratio characteristics.

SUMMARY OF THE INVENTION

The first object of the present invention is to provide a distribution type fuel injection pump capable of effectively and electrically controlling the fuel injection timing, as described above.

The second object of the present invention is to provide a distribution type fuel injection pump capable of effectively and electrically controlling the fuel injection ratio characteristic as well.

The first object of the present invention can be achieved by a distribution type fuel injection pump for distributing and delivering fuel to each of the combustion chambers in an internal engine comprising pump housing means including a pumping head in which a pumping chamber is defined; first fuel supply means for supplying fuel to the pumping chamber; fuel pressuring means for pressurizing the fuel in the pumping chamber; distributor means for distributing and delivering fuel, which has been pressurized in the pumping chamber, to each of the combustion chambers in the engine; plunger means actuated by the fuel pressure in the pumping chamber and including a control cylinder bore defined in the pumping head and a control plunger fitted into the control cylinder bore, the control cylinder bore being partitioned to a first chamber to which the fuel pressure in the pumping chamber is transmitted and which serves to apply this pressure to one end of the control plunger, and a second chamber defined by the other end of the control plunger; second fuel supply means for supplying an adjusted amount of fuel to the second chamber and including a control passage connected to the second chamber and an electromagnetic valve for opening and closing the control passage; and fuel escaping means for letting feul escape from the second chamber when the fuel pressure in the second chamber becomes higher than a certain value.

According to the above-described distribution type fuel injection pump, fuel pressure in the pumping chamber is transmitted to the first chamber in the control cylinder bore, when fuel in the pumping chamber begins to be pressurized, to thereby raise the pressure in the first chamber. The pressure in the first chamber is thus applied to one end of the control plunger, which is moved in the direction which reduces the volume of the second chamber. As long as the control plunger is being moved like this, the fuel in the pumping chamber is not pressurized. However, the fuel pressure in the second chamber is raised by the movement of the control plunger. When the fuel pressure in the second chamber is raised higher than a predetermined value, the fuel in the second chamber escapes through the fuel escaping means. When all of the fuel in the second chamber has escaped through the fuel escaping means, the control plunger is stopped. When the control plunger is stopped, the fuel in the pumping chamber begins to be pressurized. More specifically, even when the fuel in the pumping chamber is pressurized by the fuel pressurizing means, it would never be actually pressurized unless the control plunger is stopped. Therefore, the fuel in the pumping chamber begins to be pressurized after a delay from the time, and it is then fed to each of the combustion chambers in the engine. It can be therefore understood that the fuel injection timing is controlled by controlling the above-mentioned delay time. To pay a little more consideration to this delay time, it corresponds to the moving duration of the control plunger starting from the time when the plunger starts to move and ending at the time when the plunger stops moving, as apparent from the above. The moving duration of the control plunger or delay time (in other words, the initial position of the control plunger in the control cylinder bore before the fuel in the pumping chamber begins to be pressured by the fuel pressure means) can be determined by the amount of fuel filling the second chamber. Therefore, the delay time or fuel injection timing can be controlled by controlling the amount of fuel in the second chamber, by the use of the second electromagnetic valve of the second fuel supply means. Thus, it becomes possible to electrically control the fuel injection timing.

The second object of the present invention can be achieved by a distribution type fuel injection pump for distributing and deliverying fuel to each of the combustion chambers in an internal combustion engine comprising pump housing means including a pumping head in which a pumping chamber is defined; first fuel supply means for supplying fuel to the pumping chamber; pumping plunger means for pressurizing the fuel in the pumping chamber and including at least a pumping plunger and a cam means for reciprocating the pumping plunger in response to the rotation of the engine; adjusting means for adjusting the timing at which the pumping plunger is reciprocated by the cam means; distributor means for distributing and deliverying the fuel, which has been pressurized in the pumping chamber, to each of the combustion chambers in the engine; control plunger means operated by the fuel pressure in the pumping chamber and including a control cylinder bore defined in the pumping head and a control plunger fitted into the control cylinder bore, the control cylinder bore being partitioned by the control plunger into a first chamber, to which the fuel pressure in the pumping chamber is transmitted and which serves to apply this pressure to one end of the control plunger, and a second chamber, defined by the other end of the control plunger; second fuel supply means for supplying an adjusted amount of fuel to the second chamber and including a control passage connected to the second chamber and a electromagnetic valve for opening and closing the control passage; and fuel escaping means for the fuel in the second chamber to escape when the fuel pressure in the second chamber becomes higher than a certain value.

According to another distribution type fuel injection pump, the injection ratio of fuel can be controlled electrically. More specifically, the fuel injection timing is controlled by the second fuel supply means, control plunger and fuel escaping means in the case of the first distribution type fuel injection pump, while the fuel injection ratio can be controlled by these second fuel supply means, control plunger and fuel escaping means in the case of the second distribution type fuel injection pump. In a case where the fuel in the pumping chamber is pressurized by converting the rotation of the engine to the reciprocation of the pumping plunger by means of the cam of the cam means, the cam face area of the (cam which is used to actually pressurize the fuel in the pumping chamber) can be changed when the timing at which the fuel in the pumping chamber begins to be pressurized is delayed. When the cam diagram is determined appropriately, therefore, the speed at which the pumping plunger is moved at the time of actually pressurizing the fuel in the pumping chamber can be changed, thereby enabling the characteristics of the fuel injection ratio to be controlled electrically. When the characteristics of the fuel injection ratio is electrically changed like this, a lag is caused in the fuel injection timing, following the change of this fuel injection ratio characteristics, as already described in reference to the first distribution type fuel injection pump, but this lag in the fuel injection timing can be corrected by the adjusting means.

As described above, the characteristics of the fuel injection ratio can be electrically controlled according to the second distribution type fuel injection pump.

DETAILED DESCRIPTION OF THE PREFERRED EMBODIMENTS

Figure 1:
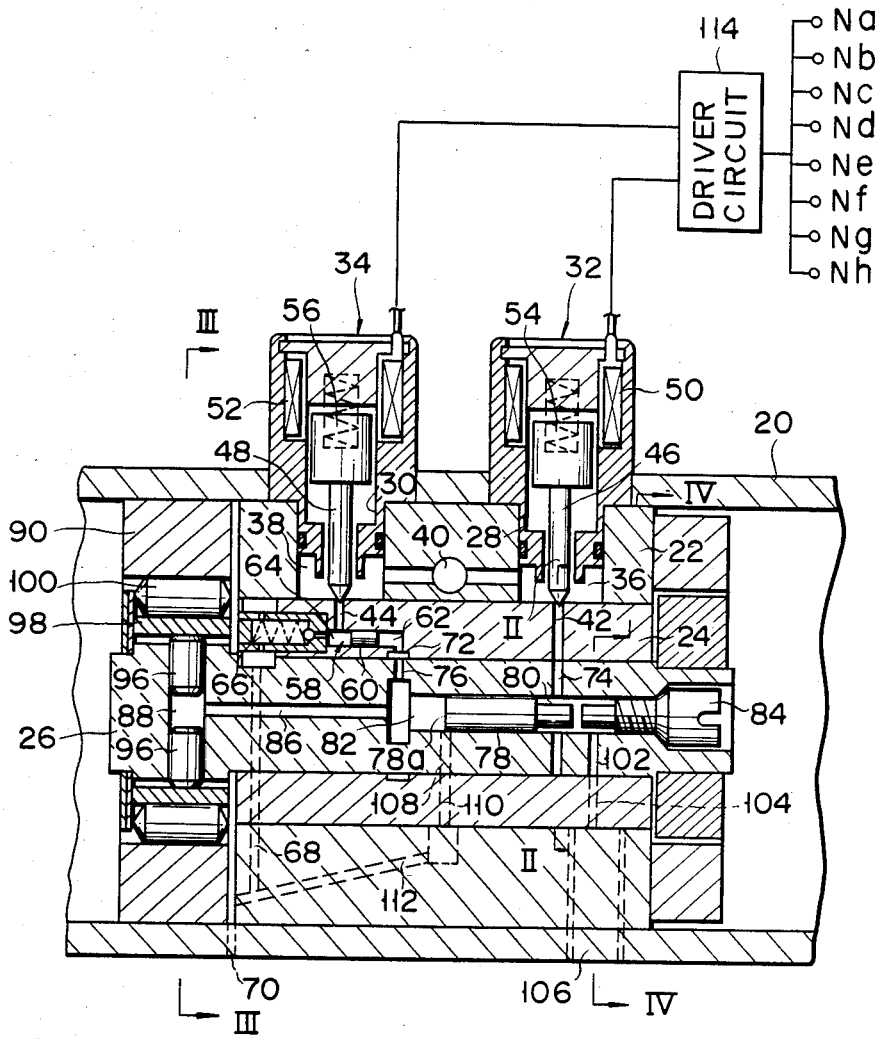
FIG. 1 is a sectional view showing a first example of the distribution type fuel injection pump according to the present invention.

FIG. 1 shows a first example of the distribution type fuel injection pump according to the present invention. This fuel injection pump is of the so-called Lucus type. The fuel injection pump is provided with a cylindrical housing 20. A sleeve 22 is fixed in the housing 20 and a pumping head 24 is fitted into the sleeve 22. A rotor 26 is rotatably fitted into the head 24 and rotated synchronous with an engine (not shown).

A pair of bores 28 and 30 are radially formed in the sleeve 22 to expose the outer circumference of the head 24. These bores 28 and 30 are separated from each other in the direction of the axis of the rotor 26. First and second electromagnetic valves 32 and 34 are arranged in the bores 28 and 30, respectively. First and second valve chambers 36 and 38 are defined by the electromagnetic valves 32 and 34 in the bores 28 and 30, respectively. A fuel supply passage 40 is formed in the sleeve 22 at the center thereof between the valve chambers 36 and 38. The fuel supply passage 40 is branched to communicate with the valve chambers 36 and 38, respectively. On the other hand, the fuel supply passage 40 is connected to a feed pump (not shown) which is driven by the engine, thereby enabling fuel to be introduced into the first and second valve chambers 36 and 38 from the feed pump, passing through the fuel supply passage 40. First and second supply holes 42 and 44 in the head 24 are connected with the first and second valve chambers 36 and 38, and those ends of the first and second supply holes 42 and 44 which are opened into the first and second valve chambers 36 and 38 are closed by valve members 46 and 48 of the electromagnetic valves 32 and 34. The first and second electromagnetic valves 32 and 34 are of the usually-closed type. Therefore, the first and second electromagnetic valves 32 and 34 are lifted against their springs 54 and 56 when current is applied to their solenoids 50 and 52. As a result, the valve chambers 36 and 38 are open to the supply holes 42 and 44, respectively, thereby causing the fuel in the first and second valve chambers 36 and 38 to be introduced into the supply holes 42 and 44, respectively.

The first supply hole 42 extends in the radial direction of the rotor 26 and one end of the first supply hole 42 is opened at the inner wall face of the head 24 into which the rotor 26 is fitted.

The second supply hole 44 is connected with a control cylinder bore 58 formed, parallel to the axis of the rotor 26, in the head 24. A control plunger 60 is fitted into the control cylinder bore 58, so that the control cylinder bore 58 can be divided into first and second chambers 62 and 64 by means of the control plunger 60. The second supply hole 44 is communicated with the second chamber 64. One end of the second chamber 64 is further communicated with a drain hole 70 through a relief valve 66 and a drain passage 68. The first chamber 62 is connected to a ring-shaped groove 72 on the inner wall face of the head 24.

Figure 2:
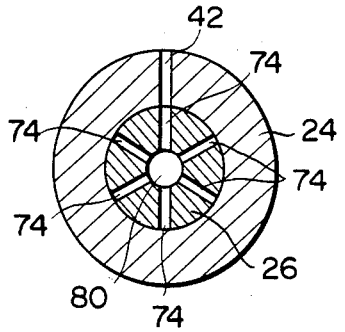
FIG. 2 is a sectional view taken along a line II—II in FIG. 1.

First plural inlets 74 which cooperate with the first supply hole 42 are formed in the rotor 26. As shown in FIG. 2, these first inlets 74 are opened at the outer circumference of the rotor 26 and separated from one another on the outer circumference thereof with an equal interval interposed between them. The number of first inlets 74 is the same as that of cylinders (six cylinders in this example) in the engine. As the rotor 26 is rotated, the first supply hole 42 in the head 24 is intermittently opened to one of the first inlets 74 in the rotor 26. A second inlet 76 which is connected with the ring-shaped groove 72 connected to the first chamber 62 is formed in the rotor 26. Regardless of the rotors rotation, the second inlet 76 is usually opened to the first chamber 62 through the ring-shaped groove 72. A free piston 78 is coaxially fitted into the rotor 26 to freely slide therein in the axial direction thereof. Therefore, a fuel pumping chamber 80 and a pressure receiving chamber 82 are defined in the rotor 26 by means of the free piston 78. The opened end of the fuel pumping chamber 80 is tightly closed by a sealing screw 84. The pressure receiving chamber 82 is communicated with a booster chamber 88 through a booster passage 86.

Figure 3:
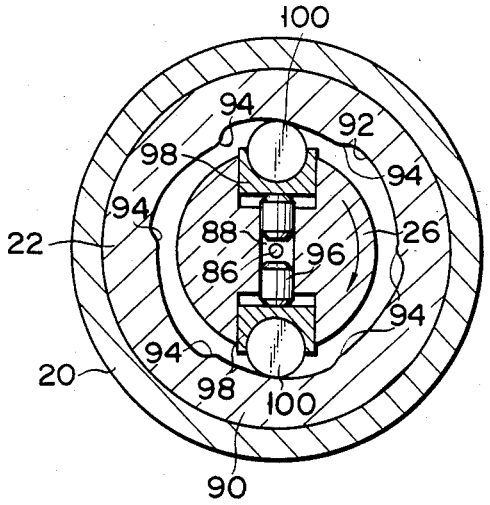
FIG. 3 is a sectional view taken along a line III—III in FIG. 1.

That portion of the rotor 26 where the booster chamber 88 is formed is projected from the head 24. The projected portion of the rotor 26 is covered by a cam ring 90, which is located adjacent to the sleeve 22 to be able to rotate in the housing 20. As shown in FIG. 3, the inner circumference of the cam ring 90 is formed as a cam face 92 and wave-like projections 94 which are equal in number to the cylinders in the engine are formed on the cam face 92 with the same interval interposed between them in the circumferential direction thereof. That portion of the rotor 26 which is covered by the cam ring 90 is provided with a pair of pump plungers 96 which are fitted in a through-hole radially formed in the rotor 26. A cam roller 100 is attached to one end of each of the pump plungers through a roller shoe 98. The cam rollers 100 are slidably contacted on the cam face 92 of the cam ring 90. The pump plungers 96 are pushed into the rotor 26 toward the axis thereof at the same time when the cam rollers 100 are slid onto the projections 94 of the cam face 92. Therefore, the pressure in the booster chamber 88 (which is between the pump plungers 96) is increased. The pressure in the booster chamber 88 is transmitted to the pressure receiving chamber 82 which is communicated with the booster chamber 88 through the booster passage 86, thereby causing the free piston 74 to be moved in the direction to reduce the volume of the fuel pumping chamber 80.

Figure 4:
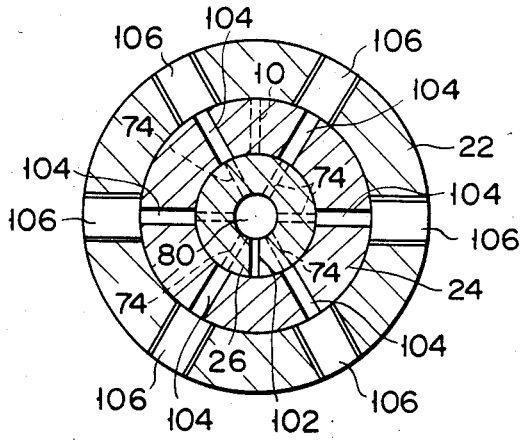
FIG. 4 is a sectional view taken along a line IV—IV in FIG. 1.

A distribution hole 102, one end of which is communicated with the fuel pumping chamber 80, is radially formed in the rotor 26. The other end of the distribution hole 102 is opened at the inner circumference of the head 24, as shown in FIG. 4. On the other hand, plural discharge holes 104, which can be communicated with the distribution hole 102, are formed in the head 24. Those ends of the discharge holes 104 which can be connected to the distribution hole 102 are opened at the inner circumference of the head 24 with the same interval interposed between them in the circumferential direction thereof, and the number of these discharge holes 104 is also the same as that of the cylinders in the engine. Each of the discharge holes 104 is communicated with the distribution hole 102 only when the first supply hole 42 is shut off from the first inlets 74. More specifically, the distribution hole 102 is shifted in phase from the first inlet 74 by an angle which is half the angle formed between the first inlets 74, as shown in FIG. 4. Each of the discharge holes 104 is connected to each of the combustion chambers (not shown) in the engine through a discharge passage 106, delivery valve and the like.

A spill hole 108 is radially formed in the rotor 26 between the first and second inlets 74 and 76. The spill hole 108 is shifted in phase from the inlet 74 by an angle which is half the angle formed between the first inlets 74. The spill hole 108 can be connected to a communication passage 110 formed in the head 24. When the free piston 78 is moved to the right in FIG. 1, the communication passage 110 is opened to the pressure receiving chamber 82 and then to a low pressure passage 112 in the sleeve 22. The low pressure passage 112 is opened to the drain hole 70, which is connected to the supply hole 40, for example.

The first and second electromagnetic valves 32 and 34 are electrically connected to a driver circuit 114, which applies valve-opening and -closing signals to the first and second electromagnetic valves 32 and 34. The driver circuit 114 receives signals applied from sensors Na–Nh for detecting the operation of the diesel engine. The sensor Na detects the fuel injection timing, Nb the number of engine rotations, Nc the oil temperature of the engine, Nd the temperature of the engine cooling liquid, Ne the depressing degree of the accelerator, Nf the atmospheric temperature, Ng the temperature of the fuel, Nf the temperature of air exhausted, and so on. When signals are applied from these sensors Na–Nh to the driver circuit 114, the driver circuit 114 applies the valve-opening and -closing signals to the electromagnetic valves 32 and 34 to optimize the amount of fuel injected and the fuel injection timing in response to the engine operation.

When the rotor 26 is rotated and one of the first inlets 74 is connected to the first supply hole 42, the distribution and spill holes 102 and 108 are shut off. When the valve-opening signal is applied from the driver circuit 114 to the first electromagnetic valve 32, the fuel which has been fed to the first valve chamber 36 is supplied to the fuel pumping chamber 80 through the first supply hole and inlet 42 and 74. The free piston 78 is thus moved by the pressure (which is increased in the fuel pumping chamber 80) in the direction to reduce the volume of the pressure receiving chamber 82. Since pressure receiving chamber 82 and the passages which are connected to the pressure receiving chamber 82 are fill of fuel, the fuel which is pushed out of the pressure receiving chamber 82 flows into the booster chamber 88 through the booster passage 86. As a result, the pump plungers 96 are moved so as to separate from each other.

When the valve-opening signal is applied from the driver circuit 114 to the second electromagnetic valve 34, the fuel which has been introduced into the second valve chamber 38 through the supply passage 40 flows into the second chamber 64 through the second supply hole 44. The fuel which has flowed into the second chamber 64 moves the control plunger 60 toward the pressure receiving chamber 62 to increase the pressure in the pressure receiving chamber 62. Therefore, the pressure in the booster chamber 88 is further raised and the pump plungers 96 are further moved in the radial direction of the rotor 26.

When the valve-closing signal is applied to the first and second electromagnetic valves 32 and 34, the valve members 46 and 48 of these first and second electromagnetic valves 32 and 34 close the first and second supply holes 42 and 44. Thus, the supply to the fuel pumping chamber 80 and second chamber 64 finishes at this point.

When the rotor 26 is further rotated by an angle, the fuel pumping chamber 80 is shut off from the first supply hole 42, and the distribution hole 102 is opened to one of the discharge holes 104.

When the first supply hole 42 and the distribution hole 102 are alternately opened to the fuel pumping chamber 80 like this, the cam rollers 100 are slid onto the opposite projections 94 on the cam face 92 of the cam ring 90 to push the pump plungers 96 toward the axis of the rotor 26. The fuel pressure in the booster chamber 88 is thus raised, as is the fuel in the passage extending from the booster passage 86 to the pressure receiving chamber 82. The fuel pressure in this flow passage is transmitted from the ring-shaped groove 72 to the first chamber 62 to push the control plunger 60 to the left in FIG. 1. The pressure in the second chamber 64 is also raised accordingly. When the pressure in the second chamber 64 is raised higher than the value which is determined by the spring of the relief valve 66, the relief valve 66 is opened. Therefore, the fuel in the second chamber 64 escapes through the drain passage and hole 68 and 70. The control plunger 60 is moved to the left until all of the fuel in the second chamber 64 has escaped through the relief valve 66. The fuel pressure in the pressure receiving chamber 82 is not increased when the control plunger 60 is being moved to the left, but it begins to be increased after the control plunger 60 stops.

When the fuel pressure in the pressure receiving chamber 82 becomes high, the free piston 78 is moved to the right to pressure the fuel in the fuel pumping chamber 80. The fuel in the fuel pumping chamber 80 is thus delivered out of the discharge hole 104 through the distribution hole 102 and injected into the combustion chambers in the engine, through the delivery valve (not shown) and the like.

When the free piston 78 continues to be moved to the right by the pressure in the pressure receiving chamber 82 and the spill hole 108 is opened by a spill lead 78*a* on the end face of the free piston 78, the pressure receiving chamber 82 is communicated with the communication passage 110 through the spill hole 108. Therefore, the high pressure fuel in the pressure receiving chamber 82 escapes on the low pressure side through the spill hole 108. The fuel pressure in the passage extending from the fuel pumping chamber 80 to the distribution hole 102 is thus made low to thereby finish the fuel injection.

When the above-described process is repeated, fuel is supplied to the fuel pumping chamber 80 through the first electromagnetic valve 32 and the fuel in the fuel pumping chamber 80 is pressurized and then injected into each of the combustion chambers in the engine.

The amount of fuel injected into each of the combustion chambers in the engine is determined by the amount of fuel supplied to the fuel pumping chamber 80 through the first electromagnetic valve 32. Therefore, the amount of fuel injected can be controlled by the amount of time the first electromagnetic valve 32 is open.

In addition, the fuel injection timing is determined by the amount of fuel supplied to the second chamber 64 through the second electromagnetic valve 34. Namely, the fuel injection timing is determined by the distance on which the control plunger 60 is moved to the left. Therefore, the fuel injection timing can be also controlled by the amount of time the second electromagnetic valve 34 is open.

According to the above-described distribution type fuel injection pump, therefore, both the amount of fuel injected and of the fuel injection timing can be controlled electrically. Further, the amount of fuel injected and the fuel injection timing can be controlled during every fuel injection. Even when the fuel injection pump is operated at an extremely high speed, the amount of fuel injected and the fuel injection timing can be controlled accurately.

The first distribution type fuel injection pump can only electrically control the amount of fuel injected and the fuel injection timing. However, the characteristics of the fuel injection ratio have to be controlled electrically as well for the purpose of reducing the combustion noise of the engine (particularly diesel engine idling or low loading) and enhancing the output of the engine at low engine loadings.

Figure 5:
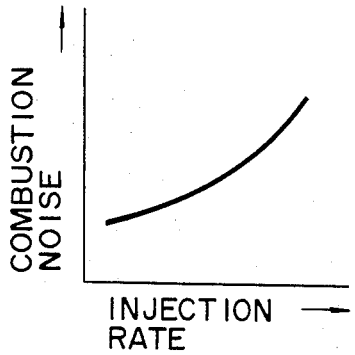
FIG. 5 is a graph showing a relationship between the fuel injection ratio and the combustion noise characteristics in the engine.
Figure 6:
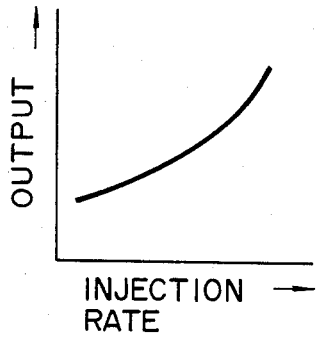
FIG. 6 is a graph showing the output of the engine relative to the fuel injection ratio.
Figure 7:
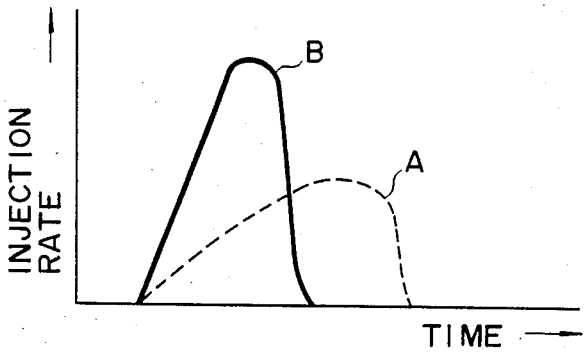
FIG. 7 is a graph showing two kinds of fuel injection characteristics of a fuel injection.

As shown in FIG. 5, for the purpose of reducing the combustion noise of engine it is better that the fuel injection ratio is small, while to enhance the output of engine the fuel injection ratio should be large. As a result, the characteristics of the fuel injection ratio shown by a curve A in FIG. 7 is demanded at the time of engine idling and low engine loading, while the characteristics of the fuel injection ratio shown by a curve B in FIG. 7 is demanded at the time of high engine loading.

A second example of the distribution type fuel injection pump enables the characteristics of the fuel injection ratio to be controlled electrically, and its arrangement will be described below.

Figure 8:
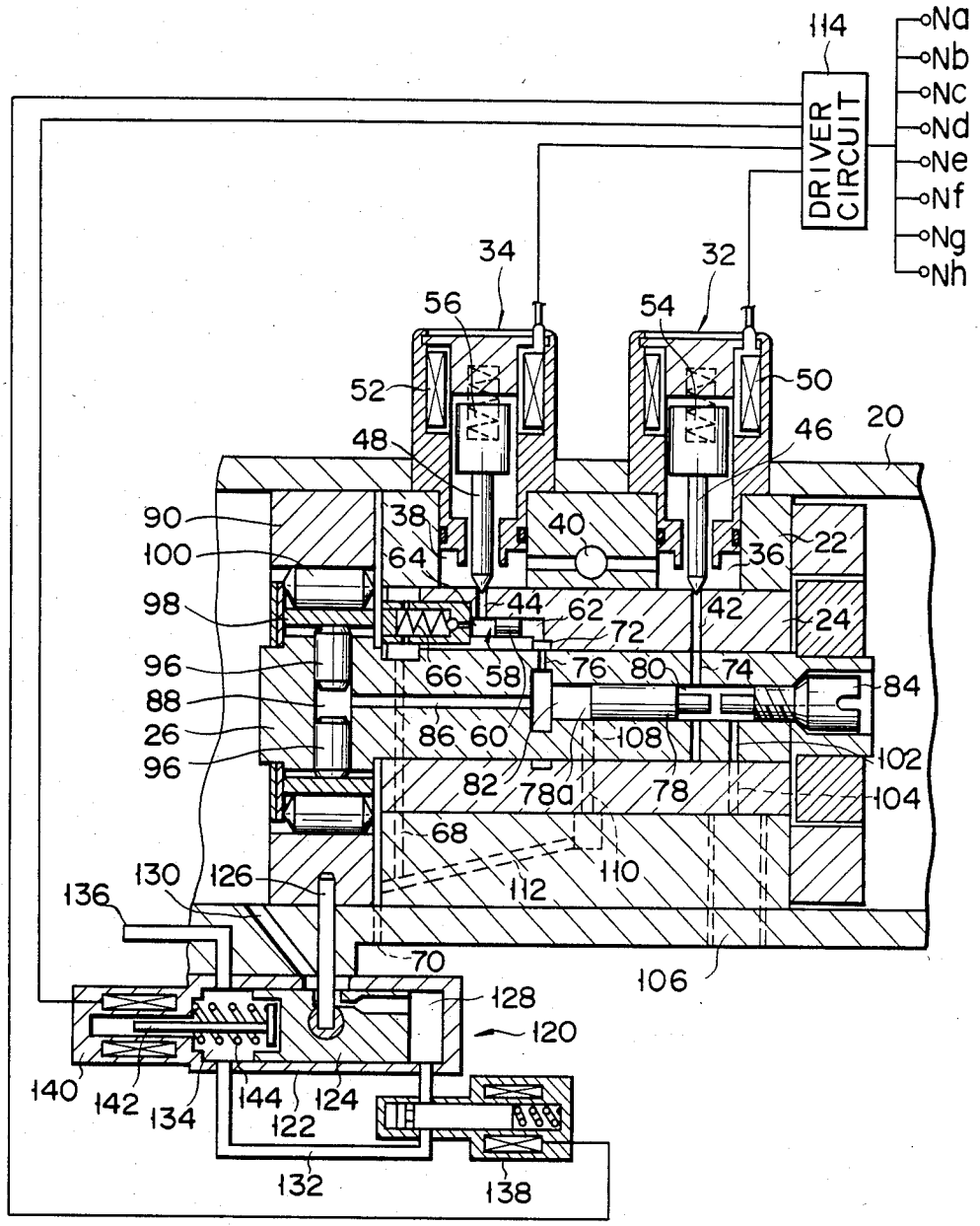
FIG. 8 is a sectional view showing a second example of the distribution type fuel injection pump according to the present invention.

FIG. 8 shows a second example of the distribution type fuel injection pump. The fuel injection pump shown in FIG. 8 is of the Lucas type similar to the one shown in FIG. 1. Therefore, same parts as those in FIG. 1 will be represented by the same reference numerals and descriptions of these parts will be omitted.

A timing controller 120 is arranged outside the housing 20. For the sake of clarity, the axis of the timing controller 120 is shown parallel to that of the rotor 26 in FIG. 8, but it is arranged actually perpendicular to the axis of the rotor 26. The timing controller 120 is provided with a timing cylinder 122, in which a timing piston 124 is slidably fitted. The timing piston 124 is connected to the cam ring 90 through a rod 126, and when the timing piston 124 is moved in the right or left directions in FIG. 8, the cam ring 90 is rotated in the circumferential direction to thereby control the timing at which the cam rollers 10 are slid onto the projections 94 on the cam face 92. A timing chamber 128, which is defined in the timing cylinder 122 by the timing piston 124, is connected to a feed pump through a passage 130 while linked with a spring chamber 134 through another passage 132. The spring chamber 134 is linked with a fuel tank (not shown) through a fuel escaping passage 136. The passage 132 is opened and closed by a third electromagnetic valve 138. A fourth electromagnetic valve 140 is attached to the timing cylinder 122. When current is applied to the solenoid of the fourth electromagnetic valve 140, a spring 144 is pulled by an armature 142 of the fourth electromagnetic valve 140. The force with which the spring 144 urges the timing piston 124 is thus released. As a result, the timing piston 124 is moved by the fuel pressure in the timing chamber 128 and the cam ring 90 is rotated thanks to this movement of the timing piston 124. The fuel injection timing is thus advanced to make engine starting excellent.

In a case where the fourth electromagnetic valve 140 is left inoperative, the pressure of fuel which is introduced into the timing chamber 128 through the passage 130 is changed, corresponding to the number of engine rotations, because the feed pump is driven by the engine. Therefore, the timing piston 124 is moved in response to the pressure change in the timing chamber 128 but against the spring 144. As a result, the cam ring 90 is rotated, responsive to the number of engine rotations, to thereby adjust the fuel injection timing automatically. When the third electromagnetic valve 138 is opened at the time of automatically adjusting the fuel injection timing like this, the pressure in the timing chamber 128 escapes through the passage 132, thereby leaving the timing piston 124 inoperative. When the operation timing of the third electromagnetic valve 138 is controlled the fuel injection timing can be adjusted.

According to the above-described second distribution type fuel injection pump, the amount of fuel injected can be controlled by the time period during which the first electromagnetic valve 32 is opened, similar to the case of the first distribution type fuel injection pump.

Different from the first fuel injection pump, the second one enables the characteristics of the fuel injection ratio to be controlled by the time period during which the second electromagnetic valve 34 is opened.

Figure 9:
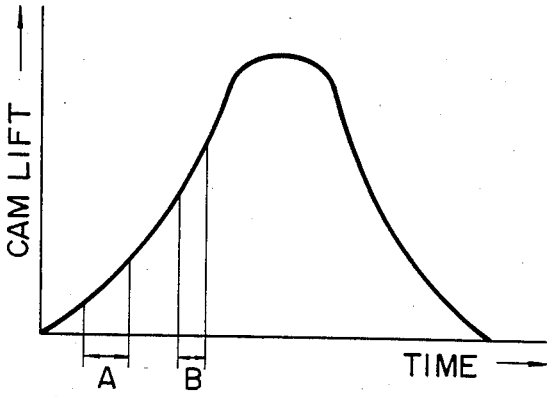
FIG. 9 is a cam diagram showing a cam ring employed by the pump shown in FIG. 8.
Figure 10:
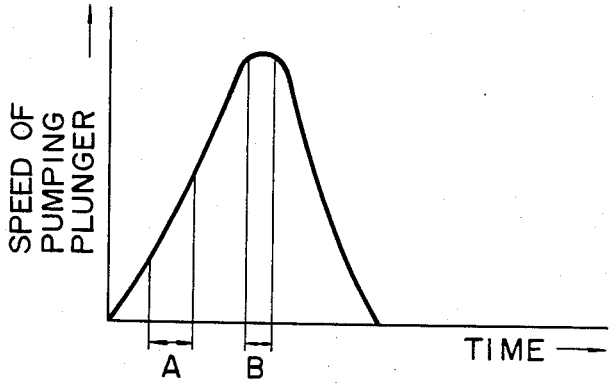
FIG. 10 is a characteristic diagram showing the moving speed of the pumping plunger shown in FIG. 8.

Although it has already been described that the fuel injection timing can be controlled by the amount of fuel which is introduced into the second chamber 64 through the second electromagnetic valve 34, this will be taken into consideration from a different standpoint. A change is caused in this case at the projection area of the cam face 92 which is used to actually pressure the fuel in the booster chamber 88. In the cam diagram of the cam ring 90 shown in FIG. 9, therefore, the moving speed of the pump plunger 94 or free piston 78 is different in a case A where an area in which the change ratio of cam lift is small is used, and a case B where another area in which the change ratio of cam lift is large is used. As a result, the characteristics of the fuel injection ratio can be changed to have one A with a low fuel injection ratio) and the other B (with a high fuel injection ratio) as shown in FIG. 7. Therefore, the characteristics of the fuel injection ratio is determined by the amount of fuel which is introduced into the second chamber 64, that is, the time period during which the second electromagnetic valve 34 is opened.

As already described above, the fuel injection timing can be controlled by applying the signal from the driver circuit 114 to the third electromagnetic valve 138 of the timing controller 120. In the case where the characteristics of the fuel injection ratio have changed, the fuel injection timing is also changed similarly, but this change of fuel injection timing can be corrected by rendering the third electromagnetic valve 138 of the timing controller 120 operative. According to the second distribution type fuel injection pump, therefore, the amount of fuel injected, the characteristics of the fuel injection ratio and fuel injection timing can be all controlled electrically.

Variations of the first and second distribution type fuel injection pumps will be described referring to FIGS. 11 and 12.

Figure 11:
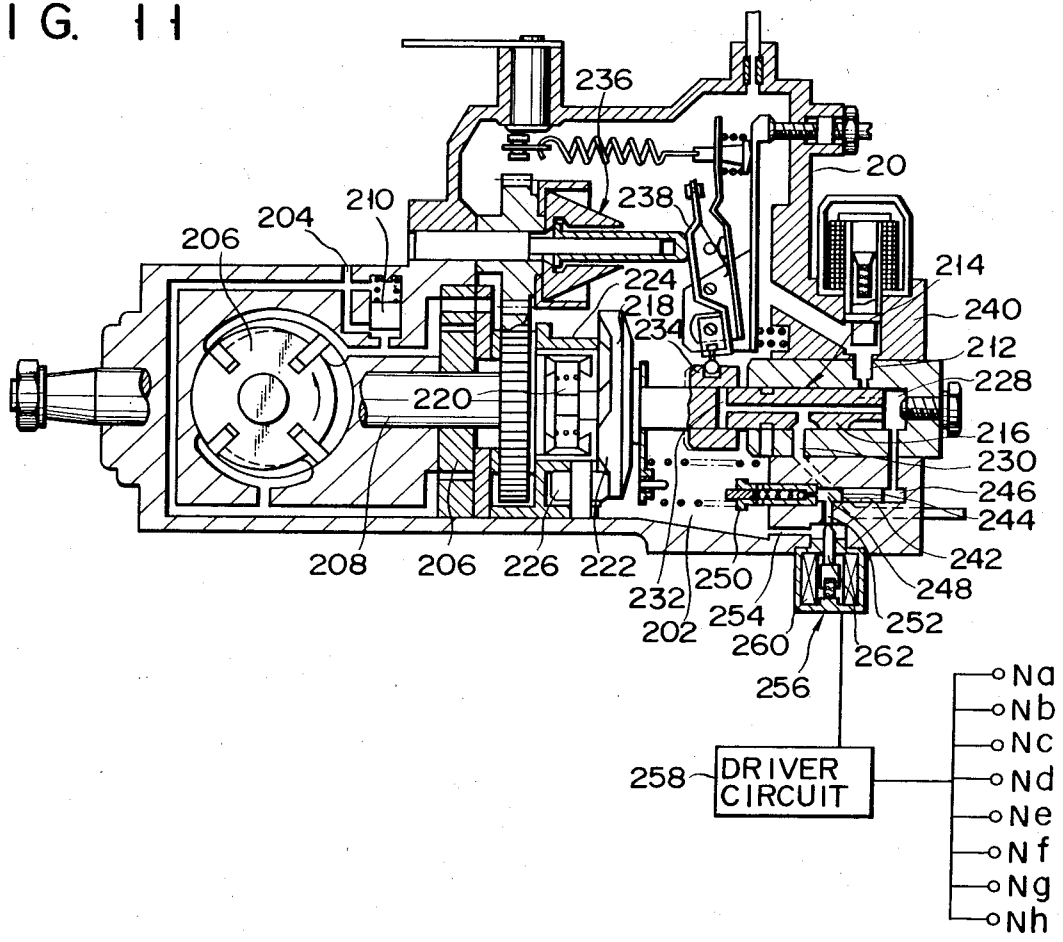
FIG. 11 is a sectional view showing a variation of the first distribution type fuel injection pump.

FIG. 11 shows a variation of the first fuel injection pump of FIG. 1. The distribution type fuel injection pump shown in FIG. 11 is of the Bosch type. A fuel supply chamber 202 is defined in the housing 20 of this fuel injection pump. Fuel is introduced from an inlet 204 of the housing 20 into the fuel supply chamber 202 through a feed pump 206, which is driven by a drive shaft 208 which is driven synchronously with the engine. A pressure adjusting valve 210 is arranged between the inlet 204 and the fuel supply chamber 202. Fuel whose pressure has been adjusted to a predetermined value is thus supplied into the fuel supply chamber 202. The fuel in the fuel supply chamber 202 is used to lubricate movable members and also fed to a plunger pump section 214 through a suction hole 212. The pump section 214 is provided with a pump plunger 216, to one end of which a face cam 218 is fixed. This face cam 218 is further connected to the drive shaft 208 through a coupling 220. Wave-like projections 222 corresponding to the number of cylinders in the engine (not shown) are formed on the cam face of the face cam 218, while a roller ring 224 has rollers 226, whose number is the same as that of the projections 222 and which are contacted with and slid on the cam face of the face cam 218.

Therefore, the pump plunger 216 is reciprocated while being rotated. As the pump plunger 216 is reciprocated, fuel which has been sucked through the suction hole 212 is introduced into a pump chamber 228. The fuel which has been introduced into the pump chamber 228 is pressurized by the pump plunger 216 and then delivered to an injection nozzle (not shown) through a distribution hole 230 and a delivery valve (not shown). The amount of fuel injected is determined by the position of a spill ring 234 in the axial direction of the pump plunger 216, the spill ring 234 serving to open and close a spill hole 232 in the pump plunger 216. When the spill ring 234 is moved to the left, the spill hole 232 is more quickly opened to the fuel supply chamber 202 by the rightward movement of the pump plunger 216. The timing at which the high pressure fuel in the pump chamber 228 escapes on the low pressure side is also made faster, that is, the fuel injection is finished more quickly, thereby reducing the amount of fuel injected. The position of the spill ring 234 is controlled by the movement of a governor mechanism 236, which is driven by the rotation of the drive shaft 208, through a link lever 238, thereby enabling the amount of fuel injected to be increased or reduced in response to the number of engine rotations.

For the sake of clarity, the axis of the feed pump 206 is rotated by an angle of 90 degrees in relation to the axis of the pump plunger 232 in FIG. 11.

A control cylinder bore 242 is formed in a head 240 and a control plunger 244 is fitted into the control cylinder bore 242. One end of the control plunger 244 defines a first chamber 246 which can open to the pump chamber 228, while the other end thereof defines a second chamber 248, which is connected to the fuel supply chamber 202 through a relief valve 250. The second chamber 248 is open to the fuel supply chamber 202 through an introduction hole 252 and a through-hole 254. The opening between the introduction hole 252 and the through-hole 254 is regulated by an electromagnetic valve 256, whose operation is controlled by a driver circuit 258. The driver circuit 158 receives signals from various sensors Na–Nh which serve to detect the; timing of the fuel injection, number of engine rotations, temperature of the engine oil and the like, and it operates these signals electrically to cause the electromagnetic valve 256 to be opened and closed so as to optimize the timing of the fuel injected. When the electromagnetic valve 256 receives the control signal applied from the driver circuit 258 to excite its solenoid 260, a valve member 262 is rendered operative to establish communication or shutoff between the introduction hole 252 and the through-hole 254.

When the pump plunger 232 is moved to the left to establish the fuel suction process under which fuel is sucked into the pump chamber 228, the electromagnetic valve 256 is opened for a certain time period, responsive to the control signal applied from the driver circuit 258. The second chamber 248 is thus filled with fuel introduced from the fuel supply chamber 202 through the through-hole 254 and introduction hole 252. Therefore, the control plunger 244 is moved a predetermined distance to the right in FIG. 11.

When the pump plunger 232 is then moved to the right to pressure the fuel in the pump chamber 228, the electromagnetic valve 258 is closed. When the fuel in the pump chamber 228 is pressurized, the control plunger 244 is moved to the left due to the pressure in the pump chamber 228 or first chamber 246, thereby causing the fuel in the second chamber 248 to be discharged into the fuel supply chamber 202 through the relief valve 250. Therefore, the fuel in the pump chamber 228 is actually pressurized for the first time after the control plunger 244 is stopped. As a result, the timing at which the fuel in the pump chamber 228 is pressurized is delayed by the a time period during which the control plunger 244 is moved to the left, that is, the timing of the fuel injection is delayed.

In the case where the actual fuel injection timing is shifted form optimumal, because of various irregularities and unexpected changes in the fuel injection pump, the time period during which the electromagnetic valve 256 is open is increased or reduced by the driver circuit 258 (since the sensor Na detects the fuel injection timing) so that the fuel injection timing can be corrected to usually keep the fuel injection timing optimumal.

Figure 12:
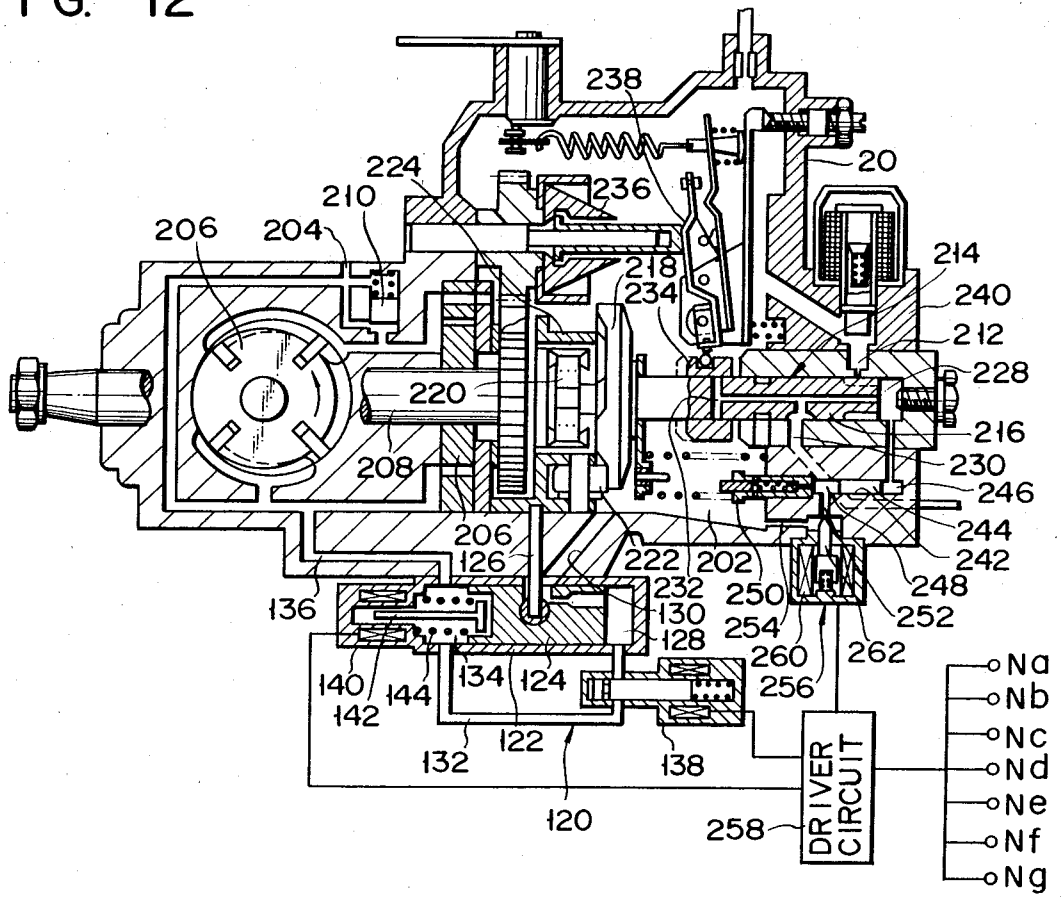
FIG. 12 is a sectional view showing a variation of the second distribution type fuel injection pump.

FIG. 12 shows a variation of the second distribution type fuel injection pump of FIG. 8. The pump in FIG. 12 is of the same type as the one shown in FIG. 11, but it further includes the timing controller shown in FIG. 8. Therefore, the same parts as those shown in FIGS. 8 and 11 will be denoted by the same reference numerals and descriptions of these parts will be omitted.

In the case of the fuel injection pump shown in FIG. 12 and similar to the one shown in FIG. 8, the characteristics of the fuel injection ratio can be controlled by controlling the time period during which the electromagnetic valve 256 is opened. In addition, the shift of fuel injection timing which is caused when the characteristics of the fuel injection ratio is changed can be corrected by the timing controller 120.

Figure 13:
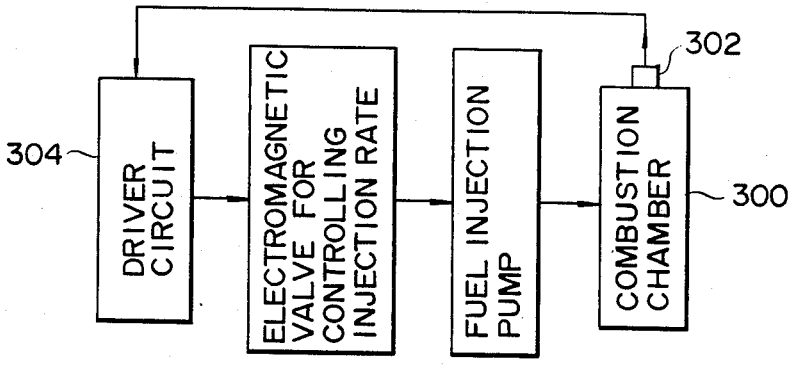
FIG. 13 is a block diagram showing a variation of the manner for controlling the fuel injection ratio.

Although the state of the engines operation has been detected by the various sensors Na–Nh and the operation of each of the electromagnetic valves has been thus controlled by the driver circuit 114 or 258 in the case of the above-described embodiments of the present invention, a control means shown in FIG. 13 may be employed. When this control means is used, the pressure in a combustion chamber 300 in the engine is detected by a pressure sensor 302 and the pressure increasing ratio in the combustion chamber is thus operated by a driver circuit 304, so that the time period during which the electromagnetic valve for controlling the fuel injection ratio is opened can be lengthened or shortened to correct the fuel injection ratio. According to the control means shown in FIG. 13, the pressure increasing ratio in the combustion chamber in the engine is detected directly. Therefore, the fuel injection ratio can be controlled to have an optimum value, corresponding to the pressure increasing ratio in the combustion chamber 300.

What is claimed is:

1. A distribution type fuel injection pump for delivering fuel to each of the combustion chambers in an internal combustion engine comprising:

pump housing means including a pumping head in which a pumping chamber is defined;

first fuel supply means for supplying fuel to the pumping chamber;

fuel pressurizing means for applying pressure to the fuel in the pumping chamber;

distributor means for distributing and delivering the fuel, which has been pressurized in the pumping chamber, to each of the combustion chambers in the engine;

control plunger means actuated by the fuel pressure in the pumping chamber and including a control cylinder bore defined in the pumping head and a control plunger fitted into the control cylinder bore, the control cylinder bore being partitioned into a first chamber to which the fuel pressure in the pumping chamber is transmitted and which serves to apply this pressure to one end of the control plunger, and a second chamber defined by the other end of the control plunger;

second fuel supply means for supplying an adjusted amount of fuel to the second chamber and including a control passage connected to the second chamber and an electromagnetic valve for opening and closing the control passage; and escaping means for allowing the fuel to escape from the second chamber when the fuel pressure in the second chamber becomes higher than a certain value.

2. A distribution type fuel injection pump according to claim 1, wherein the first fuel supply means includes a feed pump driven by the engine and a fuel suction passage for connecting the feed pump to the pumping chamber.

3. A distribution type fuel injection pump according to claim 2, wherein the first fuel supply means further includes a second electromagnetic valve for opening and closng the fuel suction passage.

4. A distribution type fuel injection pump according to claim 1, wherein the fuel pressurizing means includes a cylinder bore connected to the pumping chamber, a free piston fitted into the cylinder bore, defining the pumping chamber by one end thereof while defining a pressure receiving chamber by the other end thereof, a booster chamber linked with the pressure receiving chamber and defined between a pair of pump plungers, a third fuel supply means for supplying fuel to the booster and pressure receiving chambers, and a cam means for reciprocating the paired pump plungers, synchronous with the engine rotation, to thereby pressurize the fuel in the booster chamber.

5. A distribution type injection pump according to claim 4, wherein the first chamber is linked with the pressure receiving chamber.

6. A distribution type fuel injection pump according to claim 1, wherein the first chamber is open to the pumping chamber.

7. A distribution type fuel injection pump for delivering fuel to each of the combustion chambers in an internal combustion engine comprising:

pump housing means including a pumping head in which a pumping chamber is defined;

first fuel supply means for supplying fuel to the pumping chamber;

pumping plunger means for pressurizing the fuel in the pumping chamber and including at least a pumping plunger and cam means for reciprocating the pumping plunger in response to the engine rotation;

distributor means for distributing and delivering the fuel, which has been pressurized in the pumping chamber, to each of the combustion chambers in the engine;

control plunger means actuated by the fuel pressure in the pumping chamber and including a control cylinder bore defined in the pumping head and a control plunger fitted into the control cylinder bore, the control cylinder bore partitioned by the control plunger into a first chamber to which the fuel pressure in the pumping chamber is transmitted and which serves to apply this pressure to one end of the control plunger, and a second chamber defined by the other end of the control plunger;

second fuel supply means for supplying an adjusted amount of fuel to the second chamber and including a control passage connected to the second chamber, and an electromagnetic valve for opening and closing the control passage; and escaping means for allowing the fuel to escape from the second chamber when the fuel pressure in the second chamber becomes higher than a certain value.

8. A distribution type fuel injection pump according to claim 7, wherein the first fuel supply means includes a feed pump driven by the engine and a fuel suction passage for connecting this feed pump to the pumping chamber.

9. A distribution type fuel injection pump according to claim 8, wherein the first fuel supply means further includes a second electromagnetic valve for opening and closing the fuel suction passage.

10. A distribution type fuel injection pump according to claim 7, wherein the pumping plunger means includes a cylinder bore connected to the pumping chamber, a free piston fitted into the cylinder bore, defining the pumping chamber by one end thereof while defining a pressure receiving chamber by the other end thereof, a booster chamber linked with the pressure receiving chamber and defined between a pair of pump plungers, and third fuel supply means for supplying fuel to the booster and pressure receiving chambers.

11. A distribution type fuel injection pump according to claim 10, wherein a cam means includes a cam ring which covers the paired pump plungers, inner face of which is formed as a cam face, and cam rollers attached to the other ends of the pump plungers through roller shoes and contacted with and slid on the cam face.

12. A distribution type fuel injection pump according to claim 10, wherein the first chamber is linked with the pressure receiving chamber.

13. A distribution type fuel injection pump according to claim 11, wherein an adjuster means includes a timing controller in which a cylinder bore is defined, a timing piston fitted into the cylinder bore, partitioning the cylinder bore into a timing chamber and a spring housing chamber, means for supplying fuel to the timing chamber, the fuel having a pressure in accordance with the number of engine rotations, a spring housed in the spring housing chamber to urge the timing plunger toward the timing chamber, means for connecting the timing piston to a cam ring to match its movement to the rotation of the cam ring, and means for allowing the fuel in the timing chamber to escape at a predetermined timing, and including an electromagnetic valve.

14. A distribution type fuel injection pump according to claim 7, wherein the pumping plunger is rotated synchronously with the engine and said cam means includes a face cam attached to that one end of the pumping plunger which is remote from the pumping chamber, and a roller ring having plural rollers arranged opposite to the cam face and contacted with and slid on the cam face of the face cam.

15. A distribution type fuel injection pump according to claim 14, wherein the adjuster means includes a timing controller in which a cylinder bore is defined, a timing piston fitted into the cylinder bore, partitioning the cylinder bore into a timing chamber and spring housing chamber, means for supplying fuel to the timing chamber, the fuel having a pressure in accordance with the number of engine rotations, a spring housed in the spring chamber to urge the timing plunger toward the timing chamber, means for connecting the timing piston to a cam ring to convert the movement of this timing piston to the rotation of the roller ring, and means for allowing the fuel in the timing chamber to escape at a predetermined timing and includng an electromagnetic valve.

16. A distribution type injection pump according to claim 15, wherein the first chamber is communicated directly with the pumping chamber.

* * * * *